US009624074B2

(12) United States Patent
Becker

(10) Patent No.: US 9,624,074 B2
(45) Date of Patent: Apr. 18, 2017

(54) DRIVE UNIT FOR MOVING LOADS AND PEOPLE, AND DEVICES FOR MOVING PEOPLE AND LOADS COMPRISING SUCH DRIVE UNITS

(75) Inventor: Horst Becker, Wesserliesch (DE)

(73) Assignee: SHS Vermarktung UG (Haftungsbeschrankt) & Co. KG, Wasserliesch (DE)

( * ) Notice: Subject to any disclaimer, the term of this patent is extended or adjusted under 35 U.S.C. 154(b) by 20 days.

(21) Appl. No.: 14/114,451

(22) PCT Filed: Apr. 12, 2012

(86) PCT No.: PCT/IB2012/000736

§ 371 (c)(1),
(2), (4) Date: Oct. 28, 2013

(87) PCT Pub. No.: WO2013/050824

PCT Pub. Date: Apr. 11, 2013

(65) Prior Publication Data

US 2014/0054115 A1 Feb. 27, 2014

(30) Foreign Application Priority Data

Apr. 28, 2011 (DE) ..... 20 2011 005 664 U
May 19, 2011 (DE) ..... 10 2011 102 199
Dec. 3, 2011 (DE) ..... 20 2011 108 577 U

(51) Int. Cl.
*B66B 11/04* (2006.01)
*B66F 19/00* (2006.01)
*B66B 9/02* (2006.01)

(52) U.S. Cl.
CPC ..... *B66B 11/0446* (2013.01); *B66B 9/025* (2013.01); *B66F 19/00* (2013.01)

(58) Field of Classification Search
CPC ..... B66B 11/0446
See application file for complete search history.

(56) References Cited

U.S. PATENT DOCUMENTS

2010/0089706 A1* 4/2010 Korvenranta ..... 187/264
2010/0126807 A1 5/2010 Liao et al.

FOREIGN PATENT DOCUMENTS

CH 615138 A5 1/1980
CH 666250 A5 * 7/1988 ..... B66B 9/025
(Continued)

OTHER PUBLICATIONS

Machine translation of CH 666 250.*

*Primary Examiner* — William E Dondero
*Assistant Examiner* — Diem Tran
(74) *Attorney, Agent, or Firm* — Mendelsohn Dunleavy, P.C.

(57) ABSTRACT

The invention relates to a drive unit which comprises a motor (6)-driven spindle (5), rollers (2, 3), and cables (11), and which has a favourable transmission ratio, specifically N:1 in which N=4+n, and n is an integer between −2 and 8 including 0. Said unit is used to move loads and people, is particularly suitable for lifts, is space-saving, environmentally friendly, low-maintenance, economical in terms of energy consumption, and call be used both in the construction of new lifts and in the renovation of older installations. It allows the installation to be operated securely, and people and loads to be transported at high speeds. It can, for example, be installed at the lower or upper end of a shaft, or also outside of the shaft. It can be used for movement in a vertical, horizontal and also inclined direction, and may be provided with a counter weight.

19 Claims, 8 Drawing Sheets

(56) References Cited

FOREIGN PATENT DOCUMENTS

| | | | | |
|---|---|---|---|---|
| DE | 3621851 | A1 | | 1/1987 |
| DE | 19851726 | A1 | | 7/1999 |
| DE | 202011108577 | U1 | * | 8/2012 |
| EP | 0895957 | A2 | | 2/1999 |
| EP | 2497739 | A1 | * | 9/2012 |

* cited by examiner

Horizontal transport

Inclined transport

DRIVE UNIT FOR MOVING LOADS AND PEOPLE, AND DEVICES FOR MOVING PEOPLE AND LOADS COMPRISING SUCH DRIVE UNITS

The invention relates to a drive unit, with which devices for moving loads and people, such as elevators, can be equipped and which comprises a spindle and cables, chains or belts and with which multiple gearing and higher speeds can be achieved. The invention further relates to devices, in particular elevators for transporting loads and people, which operate with such drive units.

Drive units that can be used to move loads and people using corresponding devices, in particular elevators, have been known for quite some time.

These include, for example, the hydraulically operating systems such as those that are described in the German unexamined patent application DE 3 621 851 A1. The subject matter of this patent application is a hydraulically operated lift, which, in addition to the cabin, comprises a hydraulic cylinder which extends in the direction of travel of the cabin and in which a piston rod is moved, as well as pulleys and a counterweight connected to the piston rod. The working fluid is supplied by way of a motor-driven pump.

However, hydraulically operated drive units are very sensitive and require not only frequent monitoring and maintenance of the pump region, but also of the hydraulic cylinder system. In addition, the hydraulic fluid has to be replaced regularly, which is associated with costs and efforts. During operation, the fluid level must also be monitored and oil has to be replenished. Additionally, the properties of the fluid are highly temperature-dependent, and the environmental problems, such as risks of polluting the environment and official safety regulations, also need to be kept in mind.

It is also very unsound that large amounts of hydraulic fluid are required.

A system that operates without hydraulics, and instead employs a block and tackle system is disclosed in CH 615 138 A5, wherein the block and tackle is driven by a special motor. However, such an elevator is not particularly suited for transporting people quickly and safely. The German patent specification DE 198 51 726 C describes an elevator system, the drive system of which operates based on a spindle lifting cable drive. However, in this elevator system, the drive motor and spindle are arranged together with the parts directly associated therewith on the lower section of the elevator shaft, which is to say also beneath the elevator car. Cable deflection sheaves are attached to a pulling console located beneath the elevator system. Moreover, further deflection sheaves are arranged above the elevator car in the top of the shaft, as is a cable suspension system. The components required for driving are divided among multiple positions over the entire elevator shaft. The drive system is an integral part of the elevator system.

However, this installation only allows movements in the vertical direction. Still, this development already provides considerable advantages over the elevators known from the related art.

EP 0 895 957 A2 describes an elevator comprising a drive, in which likewise only a vertical movement is possible and in which the elevator and drive are rigidly integrated with each other. However, the driving motor acts on the nut that is present. Two cables are also provided in this design. The spindle is driven directly, and the installation has no gearing.

While a number of elevators comprising different drives are already known, a need still exists for elevators, and more particularly for drive units, that have a simple design, are versatile in the application thereof, and offer advantages over the known prior art.

It is the object of the invention to provide a refinement, improvement, and also simplification, over the known prior art, and to provide in particular a drive system that can be used not only to move loads and people in a vertical direction, but also in an inclined or horizontal direction.

It is a further object of the invention to provide a drive unit for moving loads and people, which is easy to produce using few means and has versatile uses, which can be used in particular to advantageously equip systems, which allows loads and people to be moved vertically, horizontally and in an inclined manner, by way of which heavy loads can be transported, which allows a high transport velocity, and which additionally is designed as a compact unit that can be transported either as such or accommodated in a housing and be locally mounted and used.

It is also an object of the invention to provide an advantageous transport or movement unit, in particular an elevator, which is equipped with such drive units.

A further object of the invention is to provide a transport system, in particular an elevator, comprising a drive unit that can be operated with low use of energy.

This object is achieved by a drive unit, comprising a spindle (5) that is driven by a motor (6) and acts on a nut (1), to which two or more deflection sheaves, gear wheels or pulleys (2) are attached for loose deflection, and one or more deflection sheaves, gear wheels or pulleys (3) for fixed deflection, and a fixed suspension (4) for cables, chains or belts (11), and the cables, chains or belts (11) form a gear ratio of N:1, and N=4+n, where n is an integer from −2 to +8, including 0, and the cable, chain or belt (11) can be connected directly, optionally by way of deflection, to a transport system.

Other, even higher, gear ratios are also possible.

It is preferred if n=−2 to 4, in particular 0.

The spindle is advantageously designed as a ball screw.

The drive unit may advantageously be arranged in a housing, which has an opening option for leading out and connecting the cable comprising a load.

A further object of the invention is a device for moving, raising or lowering loads or people in a vertical, horizontal or inclined direction, wherein the device comprises a drive unit of a type described above for driving purposes.

The device is preferably an elevator.

A further advantageous embodiment of the invention is an elevator, comprising a drive unit for moving a passenger and/or freight elevator up and down, the drive unit comprising a ball screw (5) that is driven by a motor (6) and acts on a nut (1), to which two or more deflection sheaves, gear wheels or pulleys (2) are attached for loose deflection, and one or more deflection sheaves, gear wheels or pulleys (3) for fixed deflection, and a fixed suspension (4) for cables, chains or belts (11), wherein the cables, chains or belts form a gear ratio of N:1 and N=4+n, and n is an integer from −2 to +8, including =0, preferably −2 to +4, including =0, and the elevator comprises two further fixed deflection sheaves, gear wheels or pulleys (7, 8), and the car/load (9) is drivably arranged by way of cables, chains or belts via the sheaves, gear wheels or pulleys (7) and (8), and the cable or chain or belt that is guided over the deflection sheave, gear wheel or pulley (8) is provided with a counterweight (10) for the car/load (9).

It is preferred if n=0, and the mass of the counterweight is advantageously exchangeable.

The invention will be described in greater detail hereafter based on the schematic drawings. In the drawings.

Due to the compact design, the freedom of motion of the elevator through the entire shaft is assured, regardless of whether the drive unit is attached to the upper or lower section of the shaft or any arbitrary location within the shaft.

Figure 1:
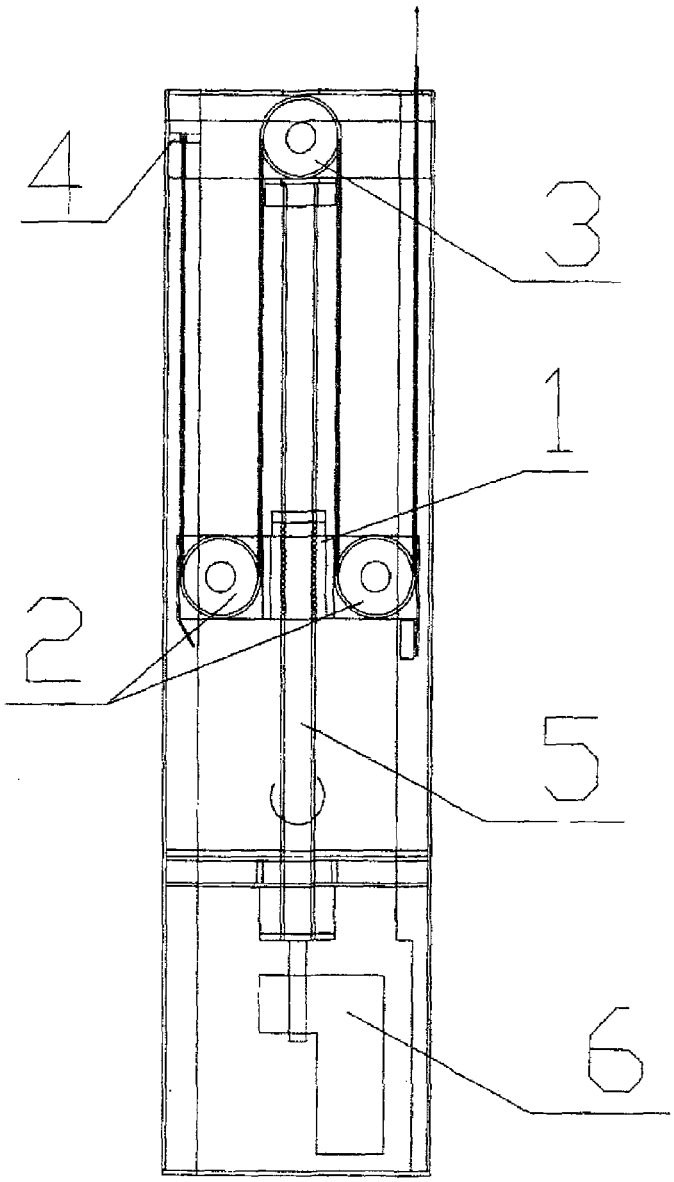
FIG. 1 shows a drive unit according to the invention arranged in a housing.

The invention will be described in greater detail based on FIG. 1, which is a schematic illustration of one embodiment. Reference numeral (5) denotes a spindle, which is surrounded by a nut (1). Two sheaves (2) are attached to the nut for the purpose of loose deflection. Depending on the direction of rotation of the spindle, these are moved up or down. Reference numeral (4) denotes a suspension, to which one or more cables (11) are attached. The figure shows one cable. It is also possible to use a plurality of cables, for example five cables, which are collectively guided over the sheaves. The lifting capacity of an elevator that is to be connected to the drive unit can be optimized by the number of cables and the weight of a potentially present counterweight, or the thickness of the cable. Reference numeral (3) denotes a sheave used for fixed deflection. Starting from the suspension (4), the cable is guided upward over the sheaves and can be attached to an elevator car from there for the purpose of moving the elevator car as the load. The cable can be guided to the load by way of appropriate deflection (not shown) and thus be used to move an elevator up and down, for example. The cable can optionally also be guided directly to the load without deflection. The spindle is driven by a motor (6).

The elevator moved upward can be provided with a device for generating electricity, with the recovery taking place on the downward motion.

The drive system according to the invention can be used in a wide variety of ways.

It is particularly suited as a drive system for elevator installations. The expenditure and costs for production are extremely low. All individual parts are inexpensive to produce or readily commercially available. The mounting time is extremely short. The drive system can be employed in the new construction of elevators and in the upgrade of old installations, for example when replacing hydraulic drives. It is very environmentally friendly because no hydraulic drive is required, and the risk of fluid leaking associated therewith does not exist. The system is extremely space-saving due to the small space requirement and can be mounted without difficulty in a shaft pit, in the shaft itself, at the top of the shaft, or also outside the shaft. It is basically possible to neglect frictional losses and wear.

The movement behavior is very precise, and no sagging at the building floor level takes place. In addition, a shaft copying system installed in the shaft can be eliminated. The installation is resistant to temperature fluctuations and penetrating impurities. The power consumption is low, and energy can be recovered during the downward motion. There are additional advantages that are not listed.

Figure 2:
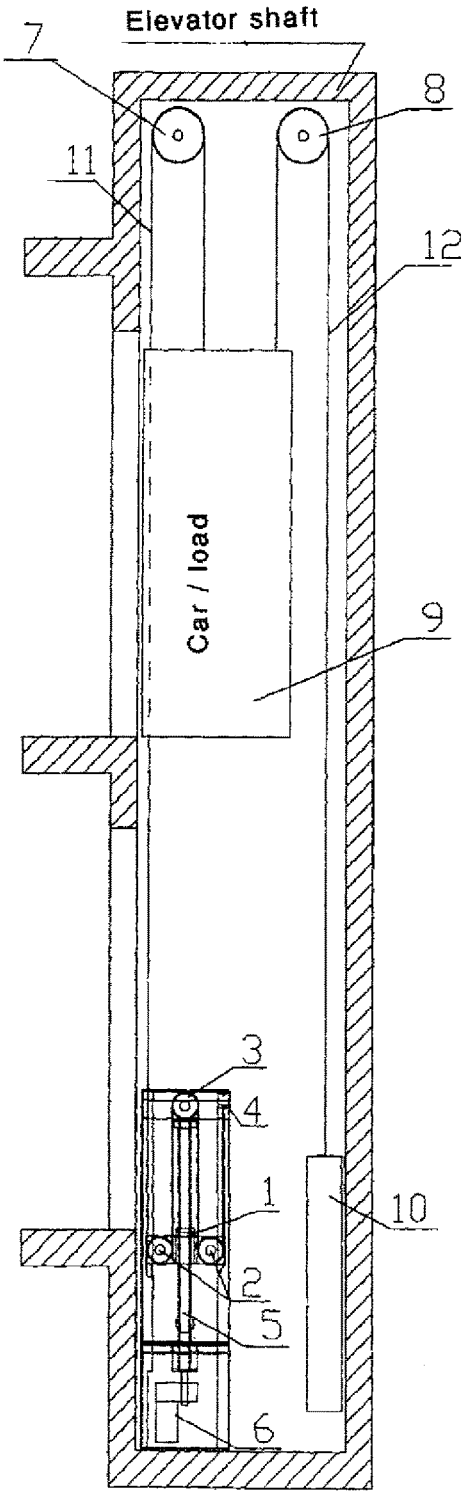
FIG. 2 shows a drive unit comprising a car and counterweight.

The embodiment comprising a counterweight is shown schematically and will be described by way of example based on FIG. 2. The unit comprises a motor (6) or other installation by way of which the spindle (5) is driven. For an emergency, for example in the event of a power failure, it may comprise a device (not shown) by way of which the spindle can be moved manually, for example. The driven, rotating spindle acts on the nut (1), to which two deflection sheaves (2) are attached. These are used for loose deflection of the cable 11, which is also attached to a fixed suspension (4). From the fixed suspension (4), the cable (11) runs over the right deflection sheave (2) to the fixed sheave (3), which is located at the upper end of the spindle, and then over the left sheave (2) to the fixed deflection sheave (7), and from there to the load (9) (car), which generally is a freight and/or passenger elevator. The counterweight (10) can be displaced up and down. The cable (12) runs from the counterweight over the fixed sheave (8) to the load, which generally is an elevator car. As a result, the counterweight acts on the load and thus reduces the force that is required to move the elevator in keeping with the gearing.

Figure 3:
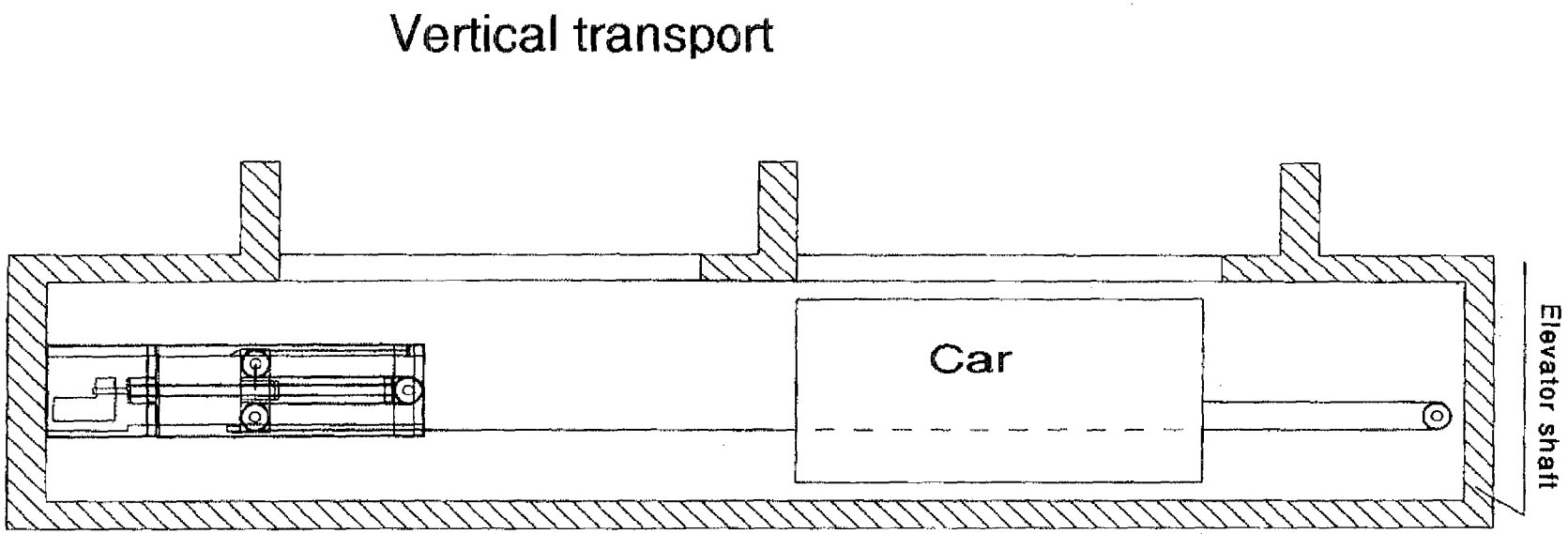
FIG. 3 is a drive unit accommodated in the lower section of an elevator shaft.

FIG. 3 shows an arrangement in which the drive unit is located at the lower section of the shaft, preferably in a shaft pit.

Figure 4:
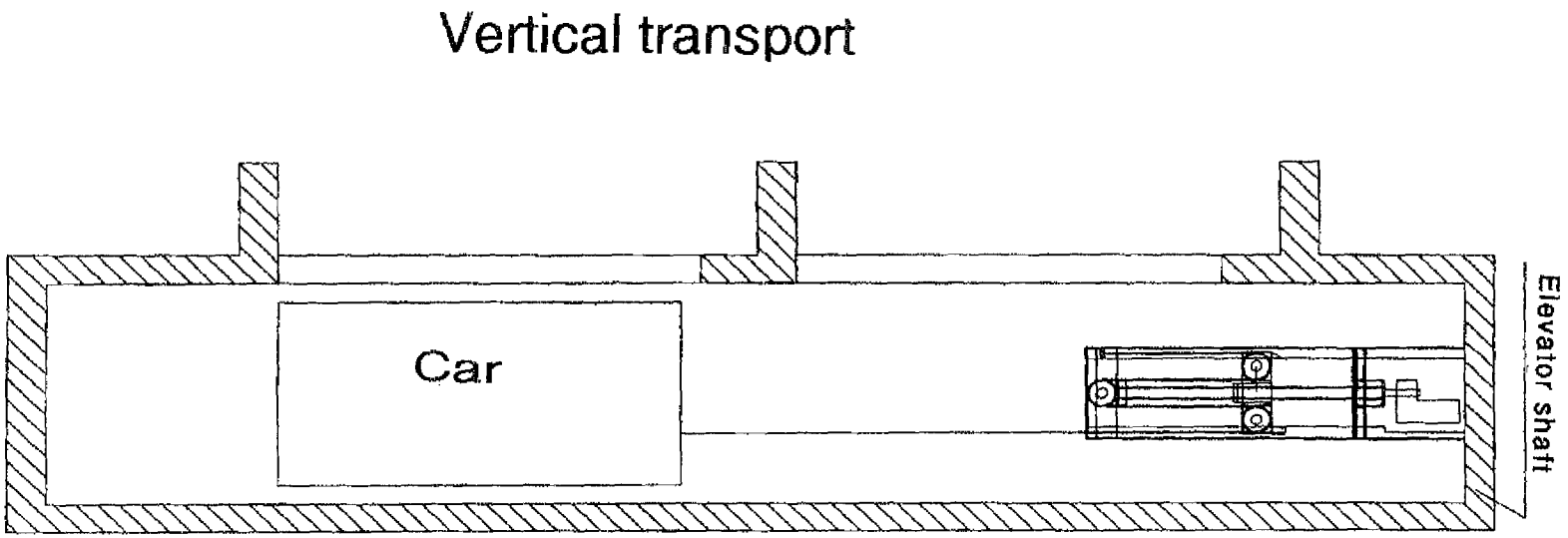
FIG. 4 is a drive unit accommodated in the upper section of the elevator shaft.

FIG. 4 shows an embodiment in which the drive unit is provided in the top of the shaft. It is also possible to provide the drive unit above the shaft ceiling and to lead the cable through an opening to the car.

Figure 5:
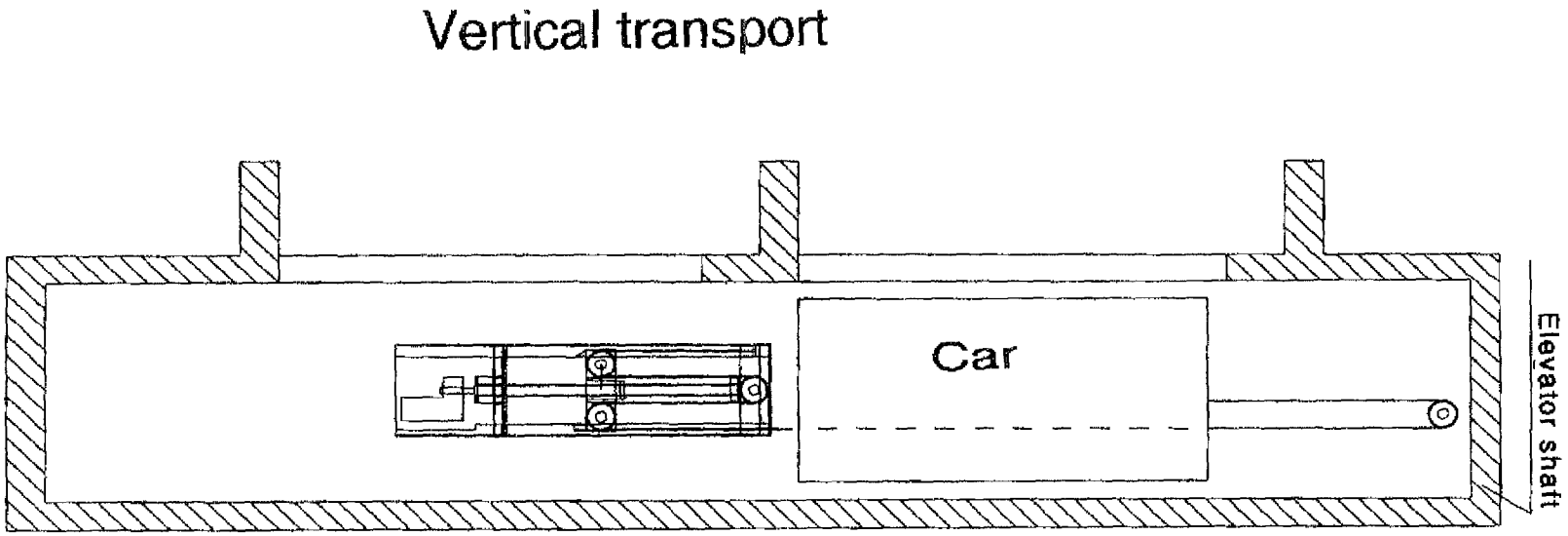
FIG. 5 is a drive unit accommodated in the central section of the shaft.

FIG. 5 shows an arrangement of the drive unit in the central section of the shaft.

Figure 6:
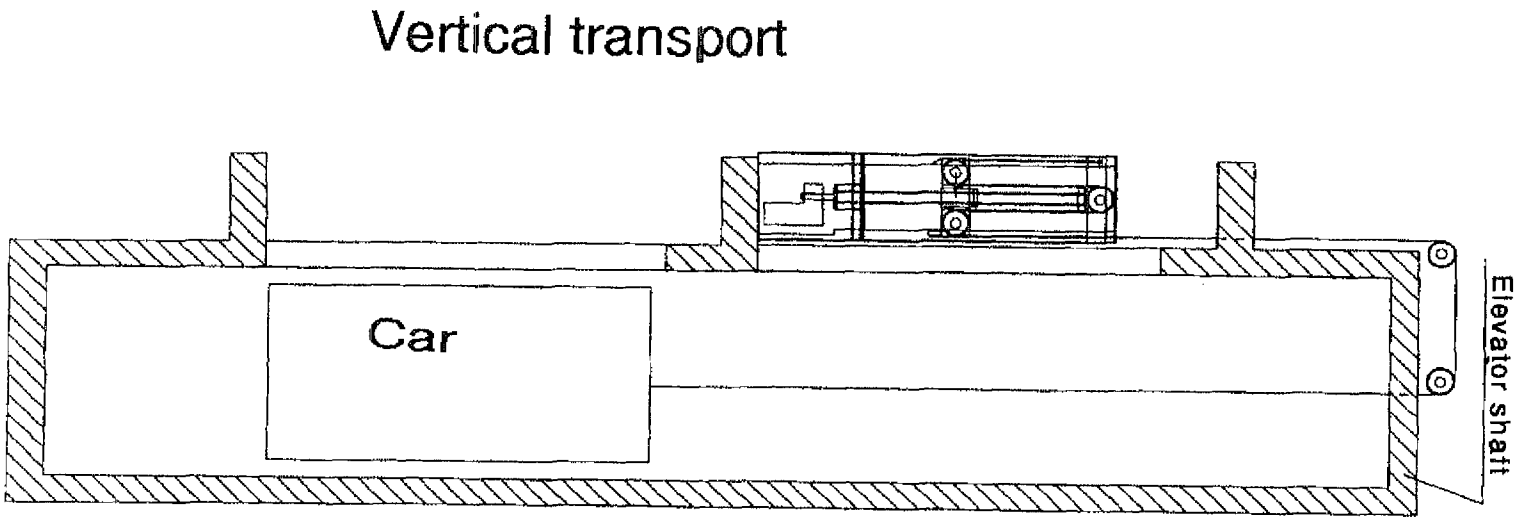
FIG. 6 is a drive unit arranged next to and outside the shaft.

FIG. 6 shows an arrangement outside the elevator shaft. The cable is guided to the elevator car over two deflection sheaves.

Figure 7:
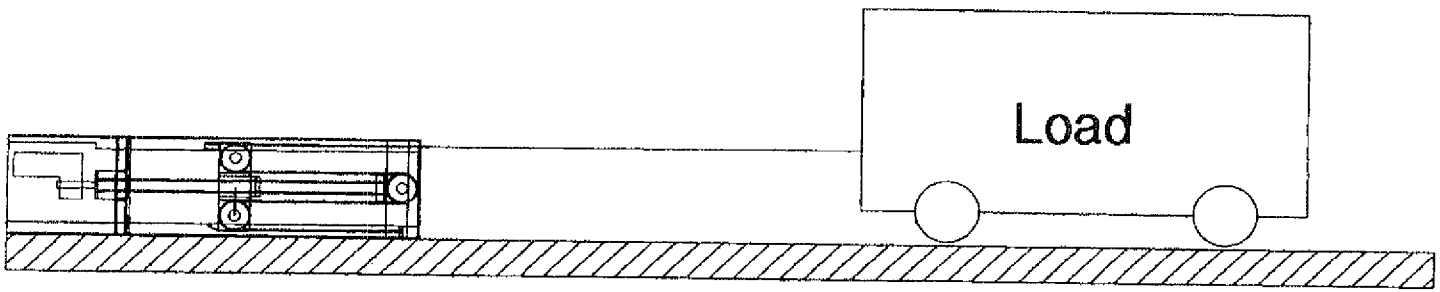
FIG. 7 shows an arrangement for horizontal transport.

FIG. 7 shows an embodiment for moving loads horizontally. For example, heavy objects, such as tree trunks, but also vehicles such as wagons can be pulled.

Figure 8:
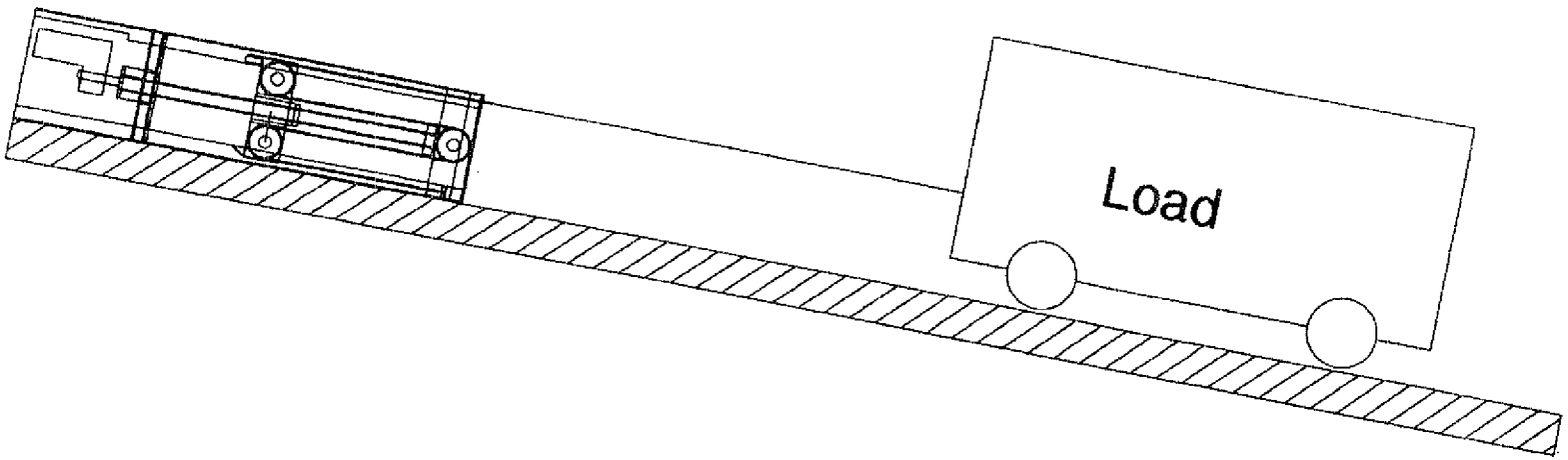
FIG. 8 shows an arrangement for inclined transport.

FIG. 8 shows one embodiment for inclined transport over sloped planes, for example an inclined lift.

By way of the invention, it is possible to reduce the energy consumption when moving the elevator. Furthermore, the load can be influenced by selection of the gearing and the path length, with the same applying to the velocity with which the elevator can be moved.

By adapting the mass of the counterweight, it is possible to adjust quickly to the weight of the car or the loads that are to be moved on a regular basis.

Due to the compact design, the drive unit can be arranged and transported in a housing and can also be used locally as an integral part together with the housing.

The invention claimed is:

1. A drive unit for moving loads or people, comprising a spindle that is driven by a motor and acts on a nut to which two or more deflection sheaves, gear wheels or pulleys are attached for loose deflection, and one or more deflection sheaves, gear wheels or pulleys for fixed deflection, and a fixed suspension for cables, chains or belts, wherein the cables, chains or belts form a transmission ratio of N:1, and $N=4+n$, where n is an integer from −2 to +8, and wherein one of said cables, chains, or belts is configured for connection to a transport system and said drive unit is configured so that the spindle, the motor, the nut, the two or more deflection sheaves, gear wheels or pulleys for loose deflection, the one or more deflection sheaves, gear wheels or pulleys for fixed deflection, and the fixed suspension are arranged in a housing configured to fit within an elevator shaft, the housing having an opening for leading out and connecting the cables, chains, or belts to the transport system.

2. The drive unit according to claim 1, wherein n is an integer from −2 to 4.

3. The drive unit according to claim 2, wherein the spindle is a ball screw.

4. The drive unit according to claim 1, wherein the spindle is a ball screw.

5. The drive unit according to claim 1, wherein n=0.

6. The drive unit according to claim 5, wherein the spindle is a ball screw.

7. The drive unit according to claim 1, wherein the drive unit is configured to be mounted on a single side of the transport system.

8. A device for moving, raising or lowering loads or people in a vertical, horizontal or inclined direction, wherein the device comprises the drive unit according to claim 2.

9. A device for moving, raising or lowering loads or people in a vertical, horizontal or inclined direction, wherein the device comprises the drive unit according to claim 4.

10. A drive unit for moving loads or people comprising a spindle that is driven by a motor and acts on a nut to which two or more deflection sheaves, gear wheels or pulleys are attached for loose deflection, one or more deflection sheaves, gear wheels or pulleys for fixed deflection, and a fixed suspension for cables, chains or belts, wherein the cables, chains or belts form a transmission ratio of N:1, and N=4+n, where n is an integer from −2 to +8, and wherein one of said cables, chains, or belts is configured for connection to the fixed suspension and to pass from the fixed suspension over one of the two or more deflection sheaves, gear wheels or pulleys for loose deflection, then pass over one of the one or more deflection sheaves, gear wheels or pulleys for fixed deflection, then pass over a second of the two or more deflection sheaves, gear wheels or pulleys for loose deflection as part of the drive unit prior to connecting to a transport system and said drive unit is configured so that the drive unit can be located on a single side of the transport system and the spindle, the motor, the nut, the two or more deflection sheaves, gear wheels or pulleys for loose deflection, the one or more deflection sheaves, gear wheels or pulleys for fixed deflection, and the fixed suspension are arranged in a housing configured to fit within an elevator shaft, the housing having an opening for leading out and connecting the cables, chains, or belts to the transport system.

11. A device for moving, raising or lowering loads or people in a vertical, horizontal or inclined direction, wherein the device comprises the drive unit according to claim 1.

12. The device according to claim 11, wherein the device is an elevator.

13. An elevator, comprising a, linear drive unit for moving a passenger elevator or a freight elevator up and down, the linear drive unit comprising a ball screw that is driven by a motor and acts on a nut, to which two or more deflection sheaves, gear wheels or pulleys are attached for loose deflection, and one or more deflection sheaves, gear wheels or pulleys for fixed deflection, and a fixed suspension for cables, chains or belts, wherein the cables, chains or belts form a transmission ratio of N:1, where N=4+n, and n is an integer from −2 to +8, and wherein the elevator comprises two fixed deflection sheaves, gear wheels or pulleys located outside of a housing configured to fit within an elevator shaft, and a car load that is drivably arranged by way of cables, chains or belts via the two fixed deflection sheaves, gear wheels or pulleys located outside of the housing, one of said cables, chains, or belts that is guided over one of said fixed deflection sheaves, gear wheels or pulleys located outside of the housing is provided with a counterweight for the car load, and wherein said linear drive unit comprises at least a second of said cables, chains, or belts which is guided over a second of said fixed deflection sheaves, gear wheels or pulleys located outside of the housing and an end of said at least a second of said cables, chains, or belts opposite of the linear drive unit is affixed to the car load, and the ball screw, the motor, the nut, the two or more deflection sheaves, gear wheels or pulleys for loose deflection, the one or more deflection sheaves, gear wheels or pulleys for fixed deflection, and the fixed suspension are arranged in the housing, the housing having an opening for leading out and connecting the at least one cable, chain, or belt to the car load.

14. The elevator according to claim 13, wherein n=−2 to 4.

15. The elevator according to claim 14, wherein a mass of the counterweight can be changed.

16. The elevator according to claim 13, wherein a mass of the counterweight can be changed.

17. The elevator according to claim 13, wherein n=0.

18. The elevator according to claim 17, wherein a mass of the counterweight can be changed.

19. The elevator according to claim 13, wherein the linear drive unit is configured to be mounted on a single side of the car load.

* * * * *